US006581702B2

(12) United States Patent
Dickey

(10) Patent No.: US 6,581,702 B2
(45) Date of Patent: Jun. 24, 2003

(54) THREE-CONE ROCK BIT WITH MULTI-PORTED NON-PLUGGING CENTER JET NOZZLE AND METHOD

(75) Inventor: Winton B. Dickey, No. 4 Songbird La., Rosharon, TX (US) 77583

(73) Assignee: Winton B. Dickey, Rosharon, TX (US)

( * ) Notice: Subject to any disclaimer, the term of this patent is extended or adjusted under 35 U.S.C. 154(b) by 39 days.

(21) Appl. No.: 09/836,046

(22) Filed: Apr. 16, 2001

(65) Prior Publication Data

US 2002/0148649 A1 Oct. 17, 2002

(51) Int. Cl.[7] ..... E21B 10/00; E21B 10/14
(52) U.S. Cl. ..... 175/340; 175/339; 175/393
(58) Field of Search ..... 175/340, 339, 175/424, 393, 57; 239/601, 597, 590.5, 552, 559, 591; 106/222, 223

(56) References Cited

U.S. PATENT DOCUMENTS 3,070,182 A * 12/1962 Runte ..... 175/339
4,106,577 A * 8/1978 Summers ..... 175/340
4,784,231 A * 11/1988 Higgins ..... 175/340
5,052,626 A * 10/1991 Wood et al. ..... 239/567
5,579,855 A 12/1996 Dickey
6,082,473 A 7/2000 Dickey
2001/0052556 A1 * 12/2001 Ting et al. ..... 239/556
2002/0112889 A1 * 8/2002 Larsen ..... 175/57

* cited by examiner

*Primary Examiner*—Thomas B. Will
*Assistant Examiner*—Meredith Petravick
(74) *Attorney, Agent, or Firm*—Kenneth A. Keeling; James E. Hudson, III

(57) ABSTRACT

A three-cone rock bit employing a non-plugging center jet nozzle with a plurality of staggered inlet orifices leading to side passageways to reduce bit balling. The nozzle defines a tapered cavity through which drilling mud flows and exits in streams. Streams are directed from the nozzle through a main exit aperture of sufficient size to avoid plugging and from side passageways boring through a sidewall of the nozzle. Jetting streams promote washing of voids within the bit and of cutting surfaces. The nozzle uses staggered inlet orifices leading to side passageways, in conjunction with a tapering shape of a central passageway to facilitate maintenance of drilling mud velocity within the central passageway and thus of stream velocity to targeted regions of the drill bit.

24 Claims, 3 Drawing Sheets

THREE-CONE ROCK BIT WITH MULTI-PORTED NON-PLUGGING CENTER JET NOZZLE AND METHOD

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of Invention

The present invention relates to the field of oil field drilling equipment. More specifically, the invention relates to a three-cone rock bit using a non-plugging center jet nozzle with a plurality of side passageways that are situated in a staggered fashion to prevent balling, or packing of the drill bit.

2. Related Art

In the drilling of oil wells, drilling fluid, or mud, provides lubrication, cooling, and cleaning by high pressure jets for the drill bit and provides for removal of the cuttings from the well bore. The mud circulates down through a drill string, into the drill bit body, typically through three nozzles positioned within the drill bit, and toward the bottom of the well bore. Nozzles are particularly useful because the relatively high-pressure mud creates high velocity jet streams within the hole and stir up formation cuttings, thus facilitating their circulation and removal from the well bore. From the well bore bottom, the mud circulates back to the surface carrying formation cuttings from the well bore. The process of removing the cuttings away from the bit and the efficiency with which it is accomplished is an important factor in determining the rate of penetration of the drill bit and, thus, the efficiency of the drilling. Therefore, increasing the efficiency of the removal of the cuttings increases the drilling efficiency.

Typically, drill bits define a void between and above cutter cones. Drilling mud and formation cuttings often accumulate within the void between and above cutting surfaces, thereby forming a mud ball that becomes impacted. This process, or phenomenon, of accumulation and impacting is generally referred to as "balling" or "packing off." Balling reduces the efficiency of the drilling process because a portion of the bit known as the dome (area above cutter cones) is packed off, causing the rotary cutter cones to become locked. This causes rotary cutter cones to skid on the bottom of the hole, therefore, slowing the rate of penetration. Thus, the drill bit and components should be designed to avoid balling.

The past benchmark for curtailing bit balling has been the installation of a fourth jet in the center of the bit (dome area). In the prior art, a single stream of drilling mud passing through the dome area of the bit provided some relief toward eroding a bit ball. However, additional improvements are needed in this area to reduce bit balling and thus improve efficiency per foot drilled. A multi-ported jet nozzle is needed to clean a larger area of dome and to reach those portions of bit domes inaccessible to the stream of a single port nozzle. Prior to the present invention, a design dilemma existed with respect to center-jet nozzles attempting a plurality of sideports (with more than one jetting stream).

Namely, in a drill bit typically employing three nozzles and a fourth center jet nozzle, flow to the center jet nozzle is limited by virtue of flow to other nozzles. Therefore, multi-ported nozzle holes on a center jet are necessarily smaller so as not to unduly diminish drilling mud flow to other non-center jet nozzles. The design dilemma with such smaller holes in multi-ported center jet nozzles is that they cannot be run in a normal drilling operation because of the risk of their becoming plugged with impediments typically present in drilling mud. When plugging of these smaller holes in the central nozzle occurs, the usefulness of the center jet is compromised. The present invention solves this problem, thus enabling the use of small orifices to be run in a multi-ported nozzle without becoming plugged.

SUMMARY OF THE INVENTION

Accordingly, the objectives of the present invention are to provide an improved drill bit that:

- provides greater drilling efficiency than previous drill bits;
- provides greater cleaning for drill bit cutting surfaces;
- provides a reduction of balling within the dome of rotary drill bits;
- provides a reduction of mud and debris accumulation in the drill bit void and on cutting surfaces;
- eliminates clogging of drill bit nozzles;
- utilizes a nozzle with a plurality of side passageways (multi-ported);
- provides an internal nozzle cavity (central passageway) shape that facilitates a constant drilling mud (fluid) velocity within the nozzle and that prevents clogging of side passageways by particles in the drilling mud;
- utilizes descending tapered shapes within the nozzle to maintain velocity of drilling mud as drilling mud is injected through the nozzle, thereby preventing clogging of side passageways by particles in the drilling mud;
- utilizes side passageways in the nozzle strategically situated at staggered heights on the nozzle body, and situated at varying angles, upward and downward to maximize cleaning, minimize balling, and increasing drilling efficiency;
- utilizes a main exit aperture on the multi-ported nozzle of sufficient size to avoid plugging, thereby ensuring that the side passageways will remain unobstructed;
- utilizes a central position of the nozzle within the drill bit;
- and that uses a range of drilling mud injection velocities into the nozzle, so that clogging is reduced within the nozzle and so that the nozzle best sustains wear from injection of drilling mud, and particularly for preventing damage within the nozzle at the point where the central passageway meets the inlet orifices to the side passageways.

To achieve such improvements, the present invention generally provides a three cone rock bit, incorporating a non-plugging center jet nozzle fixed along a vertical central axis of the drill bit body and above the cutter cones. In general, the nozzle has a main inlet aperture, a main exit aperture, and a central passageway extending between the inlet and exit apertures. Side passageways intersect the central passageway and provide a bore through the nozzle sidewall through which drilling mud exits. Typically, inlet orifices to the side passageways are staggered vertically at different heights along the nozzle sidewall defined by the descending central passageway. Each of the side passageways also has an exit orifice occurring at an exterior surface of the nozzle.

The nozzle of the present invention includes a top, a bottom, a central passageway, sidewall, and central vertical axis. A central passageway extends from the top to the bottom of the nozzle in an axial direction so that the cavity formed by the central passageway also defines a sidewall of the nozzle that preferably varies in thickness depending on the width of the central passageway. The central passageway defines an inlet aperture at the top of the nozzle, and a main exit aperture at the bottom of the nozzle. The nozzle also defines a plurality of side passageways extending through the sidewall intermediate the top and bottom of the body and with the side passageways in fluid communication with and intersecting the central passageway which has conical or other tapering shape descending to the main exit aperture.

In the preferred embodiment, a non-plugging nozzle is centrally positioned along a vertical central axis within a rotary drill bit. The drill bit has a first end comprised of a bit body adapted for connection to a drill string and a second end of the bit delimiting a cutting surface formed by a plurality of rotary cutter cones. The drill bit defines at least one void formed between and the rotary cutting devices (cutter cones). The nozzle of the present invention extends into the void, or drill dome, above the cutter cones. This center nozzle includes means for functionally connecting to and remaining in fluid communication with the drill string. The nozzle directs drilling mud from the drill string through the bit and toward target voids and cutter cones. The rotary cone drill bit has a connecting means, or pin, at the upper end of the drill bit body that connects the rotary cone rock bit to a drill string. Preferably, the connecting means, or pin, is sized and constructed to mate with the drill string. Forming the lower end of the drill bit body are a plurality of leg segments, preferably three. Rotatably mounted to each of the leg segments, a rotary cutter cone extends inwardly toward the vertical axis of the bit body. The cutter cones are conical and have a base end and an apex end. The diameter of a rotary cutter cone decreases from the base end to the apex end. The base end of each rotary cutter cone is mounted proximal a leg segment. Therefore, with a plurality of rotary cutter cones so mounted, a void, or dome is defined between the rotary cutters and above the rotary cutting surfaces. Extending longitudinally into the drill bit body from the upper end, an opening passageway provides fluid communication with the drill string. This passageway typically extends through a top portion of the bit body in an axial direction, thereby keeping the drill string in fluid communication with all nozzles in the bit. In fluid communication with the opening, one multi-ported center jet nozzle (hereinafter "nozzle" or "center-jet nozzle") directs drilling mud from the opening in a way that facilitates washing and reduction of balling within the drill bit dome, or void. The center-jet nozzle is attached within the opening passageway by connecting means and is positioned centrally above or lateral the cutter cones to direct drilling mud primarily toward the drill bit dome, well bore, and cutter cones. Preferably, the center-jet nozzle is positioned central along the drill bit vertical axis. The nozzle comprises a top end, bottom end, sidewall, and central vertical axis.

In the same embodiment, a longitudinal central passageway extends from the top end of the nozzle to the bottom end. The upper end of the central passageway has a diameter that decreases in the downward direction and toward the nozzle bottom. The nozzle attaches within the opening passageway of the drill bit by connecting means which are typically threadably screwing, or whereby the nozzle is locked down within the opening passageway. When the nozzle is attached to the drill bit, the nozzle is in fluid communication with the opening passageway. Drilling mud enters the opening passageway, moves through the inlet aperture of the nozzle, through the central passageway, through side passageways, and exits the nozzle through the main exit aperture and exit orifices (of the side passageways). Typically, the nozzle axis is vertically aligned and sharing the drill bit vertical axis. To provide for acceleration of the fluid (mud) from the cavity, the cross-sectional area (true flow area) of the main exit aperture of the nozzle is preferably greater than the cross-sectional area of at least one exit orifice concluding a side passageway on the nozzle.

The nozzle of the preferred embodiment contains a plurality of side passageways extending from the central passageway and through the nozzle sidewall. Such passageways of the nozzle are preferably positioned and adapted to produce a jetting of fluid (mud) toward the void of the drill bit and to produce a cross jetting of fluid through the void so that cuttings will not accumulate in the void, well bore, and on cutter cones. The cross jetting alleviates balling and plugging in the void. Side passageways in the nozzle typically have a constant diameter throughout their length defining cylindrical bores through the sidewall of the body. Alternately, side passageways may define an oval or slit shape throughout their length, thereby being adapted to create a fanning spray of drilling mud, thus lessening damage to cutting surfaces, which can be occasioned by high impact, tight jetting streams. Preferably, the shape of side passageways is constant throughout the entirety of side passageway length. To provide for side jetting, the side passageways extend through the nozzle sidewall at an angle perpendicular to the axis of the body or preferably at an angle of between ten and one-hundred-seventy degrees relative to the vertical axis. The range of angles allows the side passageways to direct fluid in an upward or downward direction as well as perpendicular to the axis of the drill bit. In the same preferred embodiment, side passageways are positioned on the body of the nozzle so that the inlet orifices of the side passageways are staggered in their placement on the central passageway. Staggering of inlet orifices along the central passageway is beneficial as it maintains the velocity of drilling mud through the central passageway. Side passageways draw on drilling mud flowing through the central passageway to produce side jetting. Thus, as drilling mud progresses through the nozzle, velocity of drilling mud moving through the central passageway will be inconsistent if inlet orifices leading to side passageways are randomly placed. However, properly spaced staggering of inlet orifices leading to side passageways along a descending taper shaped central passageway allows drilling mud to maintain substantially consistent velocity as drilling mud volume is channeled through side passageways selectively. Where staggered orifices are in place, velocity of drilling mud progressing through the nozzle has an opportunity to back up to its initial velocity before a subsequent inlet orifice draws on the volume of drilling mud within the central passageway. Consistent velocity within the central passageway is needed to maintain flow and to curtail small impediments in the drilling mud from plugging in the smaller inlet orifices leading to side passageways of the nozzle. This velocity will also cause temporarily obstructing particles and impediments in the drilling mud to be worn and washed away by fluid action, therefore reopening the small side passageways (side jets) in a short period. In this embodiment, the central passageway of the nozzle has a conical taper shape descending to the main exit aperture. This main exit aperture will be of sufficient size to avoid plugging, therefore permitting maintenance of central passageway velocity of drilling mud. The main exit aperture has a diameter of at least 8/32 inches. Preferably, the main exit aperture has a diameter in a range of 8/32 to 20/32 inches. A descending tapering shape of the central passageway additionally maintains velocity of drilling mud within the central passageway, despite the existence of a plurality of staggered side passageways directing flow of the drilling mud in various directions. Functionally applying the above described apparatus provides a method of reducing mud accumulation in the dome of the rock bit and on cutter cones, thereby, improving the effectiveness of the center jet nozzle.

A second embodiment of the center jet nozzle has the same limitations of the first nozzle, however, the central passageway of the nozzle defines a sectional descending shape. The sectional descending passageway maintains fluid velocity within the nozzle central passageway, as does the tapered passageway defined by the first embodiment, however, further providing a sectional contoured shape that facilitates movement of drilling fluid and which further resists clogging of side passageways by kicking small impediments toward the center of the cavity. Volume of fluid passing through this central passageway decreases with the shape of the passageway, consequently, fluid velocity is maintained in the central passageway, despite the presence of a plurality of staggered side passageways which draw on fluid (drilling mud) flowing through the central passageway.

The first and second embodiments of the present invention are optimally realized by propelling drilling mud through the central passageways at velocities causing minimal damage to nozzle components and which are most likely to avoid clogging of side passageways. Accordingly, the present invention provides for methods of using the rotary drill bit and contained non-clogging nozzles wherein drilling mud within the central passageway is optimally propelled at a velocity in the range of 75 to 300 feet per second as measured within the nozzle central passageway.

BRIEF DESCRIPTION OF THE DRAWING

The manner in which these objectives and other desirable characteristics can be obtained is explained in the following description and attached drawings in which.

Figure 1:
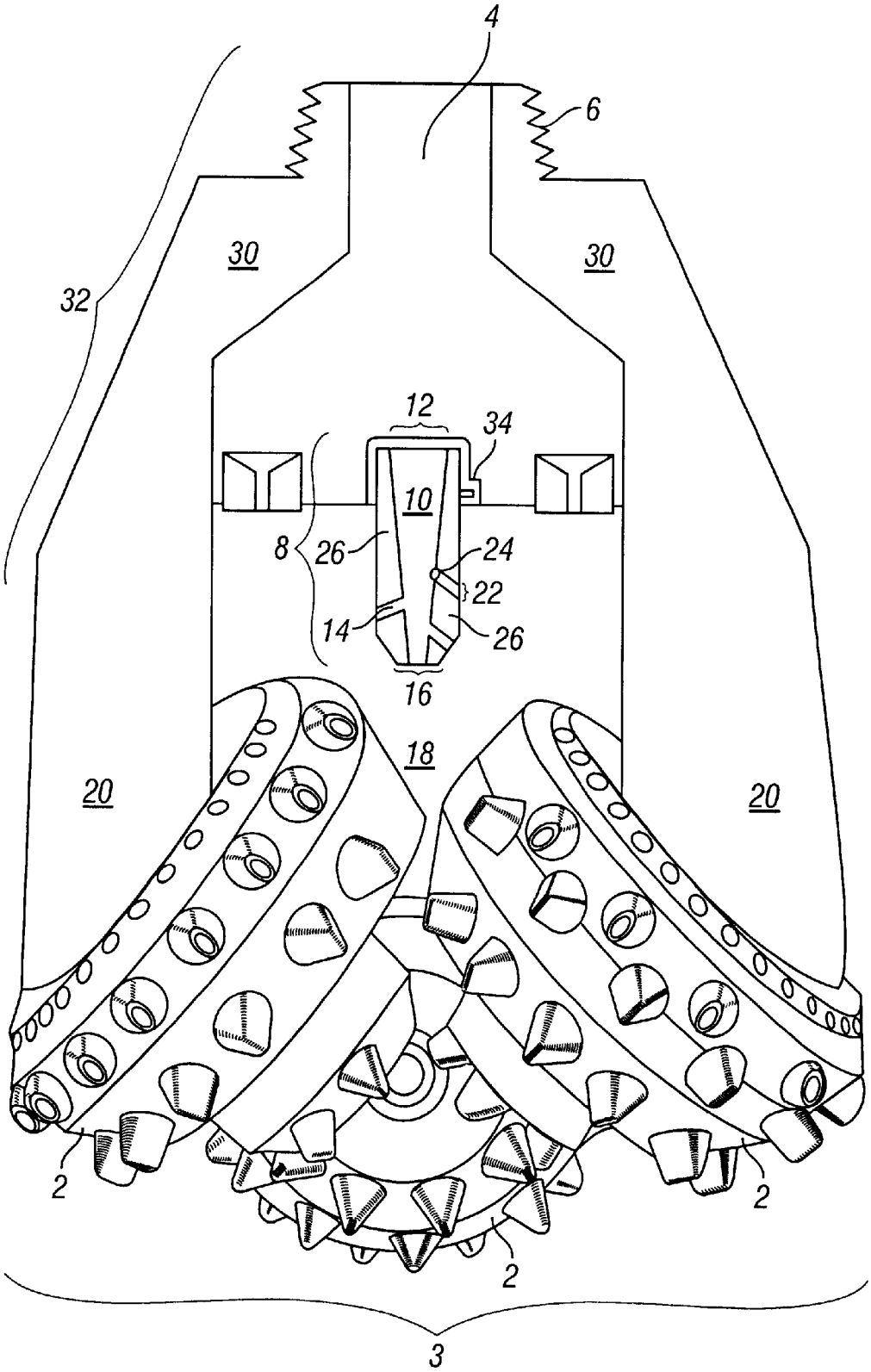
FIG. 1 is a side cross-sectional view of the three cone rotary drill bit with a non-plugging center jet nozzle employing staggered side passageways.

It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

The present invention generally provides a non-plugging center jet nozzle 8 and a self-cleaning drill bit, particularly a three-cone rotary drill bit 32, incorporating a nozzle 8. In general, the nozzle 8 has an inlet aperture 12, a main exit aperture 16, and a plurality of side passageways 14. Preferably, the inlet aperture 12 on the nozzle 8 has a greater cross-sectional area than the sum of the cross-sectional areas of the main exit aperture 16 and all exit orifices 22 on the nozzle 8. The exit aperture 16 is of sufficient size (preferably at least 8/32 inch diameter) so as not to be plugged by any impediments in drilling mud. Preferably, the main exit aperture has a diameter in a range of 8/32 to 20/32 inches. So long as the exit aperture 16 remains unplugged, then smaller inlet orifices 24 to side passageways 14 will avoid permanent clogging. The side passageways 14 intersect the central passageway 10. Typically, the side passageways 14 intersect the central passageway 10 at sharp angles, thereby, particles within the drilling fluid, or other transmitted fluid, cannot become lodged within the relatively smaller side passageways 14 and the nozzle 8 is non-plugging. The nozzle 8 may be applied to a drill bit 32 to make the bit self-cleaning. Further, applying a nozzle 8 that includes a plurality of side passageways 14 provides side jetting that is precisely directed to cutter cones 2, or preferably the void 18 within the drill bit 32, thereby reducing the risk of balling, or packing off, and plugging. The intersection of the passageways 14 typically does not include any chamfer, taper, bevel or the like, but rather at a sharp angle. Therefore, the intersections (formed by inlet orifices 24) of the side passageways 14 and the central passageway 10 do not create any enlarged areas, or cavities, within which a particle may become embedded. Inlet orifices 24 forming the intersection lead to side passageways 14 which preferably define cylindrical bores of constant diameter extending through the nozzle sidewall 26. Alternately, side passageways 14 may define oval or slit shapes throughout their length which are adapted to create a fanning spray of drilling mud. The present invention generally provides for a nozzle 8 that is centrally mounted along a vertical axis of the drill bit 32 so that it directs drilling mud from directly above the center of cutter cones 2 and preferably toward the void 18 defined within the drill bit 32. The central passageway 10 of the present invention has a descending tapering shape, either conical descending 10 or sectional descending 28, so that as fluid moves through the nozzle 8, velocity of the drilling mud stream is maintained within the central passageway 10. Side passageways 14 feed from the flow of drilling mud proceeding through the central passageway 10, however, the descending taper shape of the central passageway (10 or 28) reduces the risk of diminished fluid velocity that would otherwise result from use of side passageways 14. Additionally, the present invention employs vertically staggered placement of the side passageways 14 to further reduce the risk of diminished fluid velocity. Because the inlet orifices 24 to side passageways 14 are staggered, fluid velocity is not reduced by subsequent side passageways 14 before fluid has a chance to proceed through the tapered central passageway 10 whose shape facilitates maintenance of fluid velocity as drilling mud progresses through the nozzle 8. Preferably, the area of a cross-sectional horizontal plane within the central passageway 10 (or 28) at the point of each inlet orifice 24 is greater than the sum of the cross-sectional area of the main exit aperture 16 and the cross-sectional areas of all exit orifices 22 occurring below the cross-sectional horizontal plane.

FIG. 1 is a side cross-sectional view of the preferred embodiment of a three-cone rotary drill bit 32 with a center jet nozzle employing staggered side passageways 14. Generally, a rotary cone drill bit 32 comprises a bit body 30, a connecting means 6, an opening passageway 4 to the drill string, a nozzle 8, a plurality of leg segments 20 (the lower portion of the bit body 30), and rotary cutter cones 2 extending from the leg segments 20. The drill bit 32 has a vertically aligned axis as does the nozzle 8 within the drill bit 32. The upper end of the bit as depicted in this drawing has a connecting means 6, sometimes referred to as a pin, which provides for attachment of the rotary cone drill bit 32 to a drill string. Preferably, the connecting means 6 is sized and constructed with threads so as to threadably mate with a drill string. Alternately, the connecting means can be a weld, or a locking means.

Extending longitudinally into the drill bit body 30 and through the connecting means 6, an opening passageway 4 provides fluid communication with the drill string. The nozzle 8 is attached within the opening passageway 4 by connecting means. The opening passageway 4 is sized to communicate sufficient fluid (drilling mud) from the drill string, through all exterior nozzles of the drill bit 32, to the center jet nozzle 8, and to the well bore bottom for efficient drilling. The nozzle 8 has a connecting means for attaching to the opening passageway 4. Preferably, such connecting means is comprised of a locking attachment. The nozzle 8 is preferably designed to fit tightly within the opening passageway 4 and is secured by either a lock down mechanism or by a threadable screwing device (such as a screw down o-ring component) that permits drilling mud to pass through the opening passageway 4 and through the statically positioned nozzle 8. The nozzle 8 additionally preferably has a mating fixture 34 adapted to orient the nozzle 8 as connected within the opening passageway 4. This mating fixture 34 serves the purpose of locking the nozzle 8 into a static position when the nozzle 8 is connected within the opening passageway 4. This mating fixture 34 preferably takes the form of a mating dowel pin extending from an exterior surface of the nozzle sidewall 26. When the nozzle 8 is inserted into the opening passageway 4, this connecting fixture 34 prevents rotation of the nozzle 8. Alternately, said nozzle 8 may take the form of a screwing attachment that comes to rest at a specified position so that the nozzle 8 points in a predetermined direction. Yet another means for preventing movement of the nozzle 8 is a groove extending along the length of the exterior surface of the sidewall 26 and that is adapted to mate with a raised ridge formed in the opening passageway 4.

A plurality of leg segments 20 form the lower portion of drill bit 30 and extend from the lower end of the drill bit, generally in a downward direction. The leg segments 20 are equally spaced from one another and typically, three leg segments 20 are present in the rotary drill bit. Rotably attached to each of the leg segments 20 are rotary cutter cones 2 that provide a cutting surface 3 for the cutting action of the rotary cone drill bit 32. Each rotary cutter cone 2 has a generally conical shape. Each rotary cutter cone 2 attaches to its corresponding leg segment 20 at the base of the rotary cutter cone 2. From the leg segment 20, the rotary cutter cones 2 extend at an angle downward toward the axis of the drill bit 32.

In fluid communication with the opening passageway 4, a nozzle 8 directs the flow of drilling mud through and into the void 18 of the rotary cone rock bit 32 and onto cutter cones 2 of the drill bit. The void 18 defined above the cutter cones 2 is sometimes referred to as a drill bit dome. Effectively, this flow of fluid within the void 18 and through the void 18 onto the rotary cutter cones 2 reduces balling in the drill bit void 18. The nozzle 8 is attached and positioned centrally along the vertical axis of the drill bit 32, thereby effectively directing fluid to the void, cutters, and surfaces most effected by balling.

Figure 4:
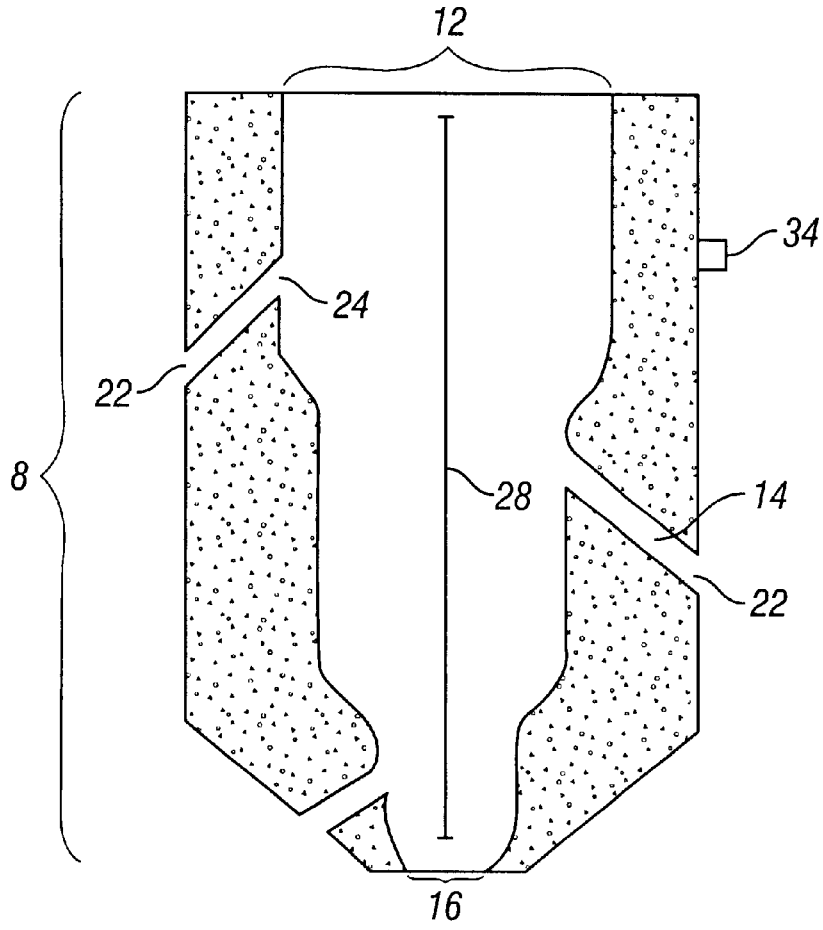
FIG. 4 is a side cross-sectional view of a non-plugging center jet nozzle with a sectional descending central passageway and a plurality of staggered side passageways.

In the preferred embodiment, the nozzle 8 is fastened to the passageway 4 by a connecting means, preferably locking statically into place. The nozzle 8 is connected so as to descend along the central axis of the drill bit 32, and through the drill bit body 30 and partially into a void 18 directly above the cutter cones 2. Drilling mud flows through the passageway 4 and into the nozzle 8 through an inlet aperture 12 defined in the nozzle 8. After entering the nozzle 8 through the inlet aperture 12, drilling mud proceeds through a central passageway 10 that has a descending tapered shape, and through a main exit aperture 16 at the base of the nozzle 8. FIG. 1 depicts a central passageway 10 with a conical descending shape, however, alternate descending shapes are also preferably used to direct drilling mud through the nozzle 8. For instance, the central passageway 10 may have a sectional descending shape 28 (FIG. 4). The essential feature of the central passageway 10 of the nozzle 8 is that a descending or tapering shape allows for maintenance of velocity as drilling mud proceeds through the length of the nozzle 8.

The preferred embodiment in FIG. 1 additionally depicts side passageways 14 boring through the sidewall 26 of the nozzle 8 and which are in fluid connection with the central passageway 10. The side passageways 14 have an inlet aperture 24 through which drilling mud enters and an exit orifice 22 through which drilling fluid exits. Preferably, the points of intersection between the central passageway 10 and the side passageways 14, at the inlet aperture 24, are defined by sharp angles. This means the inlet aperture 24 itself is round, however without a beveled edge, the sharp edge thus preventing entrance of particles that might otherwise proceed into a beveled inlet orifice. Alternately, side passageways may define oval or slit shapes throughout, being adapted to create a fanning spray of drilling mud. The side passageways 14 in the preferred embodiment permit precise directing of the flow of drilling mud toward at least one void 18 within the drill bit 32, toward cutter cones 2, and toward portions of the void 18 inaccessible to the main center jet stream. Side passageways 14 permit directing flow of mud to otherwise inaccessible portions of the void of the drill bit 32 interior.

The side passageways 14 of the preferred embodiment are vertically staggered. Side passageways 14 draw on the fluid proceeding through the central passageway 10. Absent a descending taper of the central passageway 10 and staggering, such drawing of fluid by side passageways 14 reduces the fluid velocity within the nozzle central passageway 10. Preferably, inlet orifices 24 leading to side passageways 14 are vertically staggered along the central passageway 10 to define a distance between the midpoints of inlet orifices 24 on the nozzle.

Figure 2:
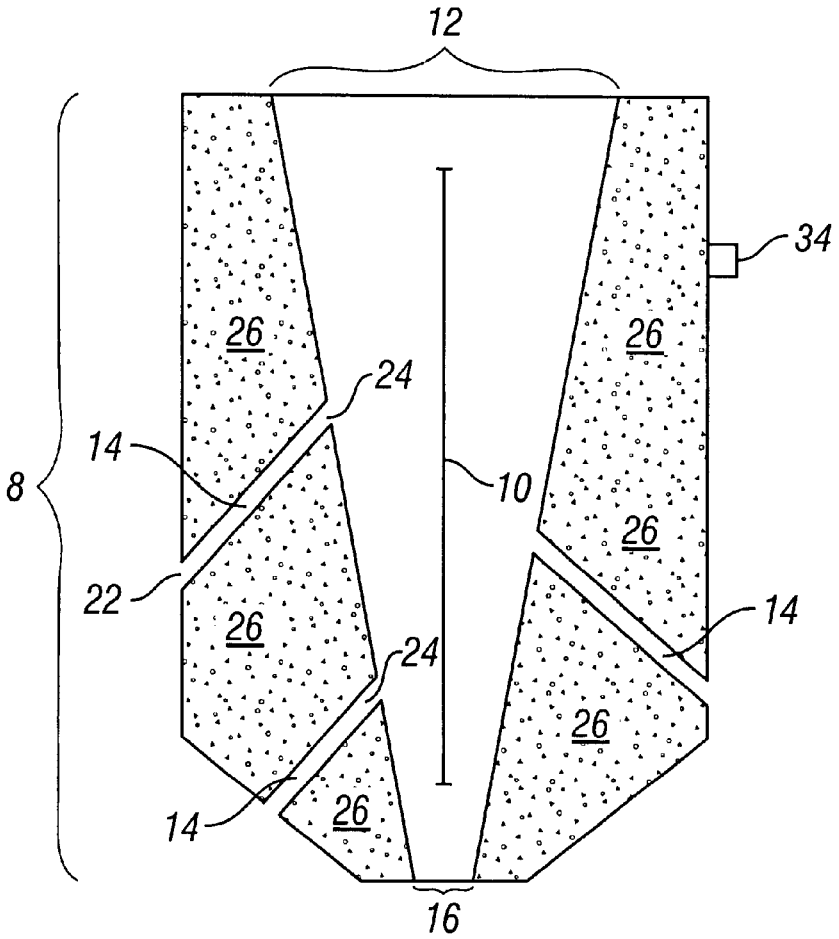
FIG. 2 is a side cross-sectional view of a non-plugging center jet nozzle with a conical descending central passageway and a plurality of staggered side passageways.

FIG. 2 is a side cross-sectional view of a non-plugging center jet nozzle 8 with a conical descending central passageway 10 and a plurality of staggered side passageways 14. FIG. 2 depicts in greater detail the nozzle 8 found in the preferred embodiment of the three-cone drill bit 32 as shown in FIG. 1. The inlet aperture 12 is found at the top of nozzle 8. The inlet aperture 12 is larger in cross-sectional area (true flow area) than the combination of all cross-sectional areas of exit orifices 22 and the main exit aperture 16. This feature causes the velocity of fluid within the central passageway 10 to be maintained as drilling mud is propelled through the central passageway 10 and out of the exit aperture 16. Additionally, this feature causes the jetting action of the drilling mud exiting the nozzle 8. Between the inlet aperture 12 and the exit aperture 16, the nozzle 8 defines a conical descending taper shape, namely the central passageway 10.

The central passageway 10 also defines a nozzle wall 26 whose thickness preferably relates inversely to the thickness of the central passageway 10. As the central passageway 10 narrows to a taper and toward the exit aperture 16, the nozzle wall 26 preferably increases in thickness, however alternate relationships are contemplated, including but not limited to a relationship wherein the sidewall 26 and the central passageway 10 both define like tapering shapes.

A plurality of side passageways 14 bore from the central passageway 10 through the nozzle sidewall 26 providing a channel through which drilling mud will flow, exiting the nozzle side wall 26 at an exit orifice 22. The side passageways 14 direct drilling mud flowing through the nozzle 8 in a precise manner toward the void 18 (FIG. 1) in a rotary drilling bit 32 and toward rotary cutter cones 2 (FIG. 1). By directing drilling mud toward such drill bit 32 components and voids 18, the side passageways increase the efficiency of the drill bit 32 by reducing "balling" or "packing off" that occurs if cuttings from the well bore are not removed. The drilling mud additionally provides cleaning for the cutting surface 3 and cutter cones 2. At the inlet orifice 24 where the side passageways 14 intersect with the central passageway 10, the inlet orifices 24 preferably form sharp angles to prevent the inflow of drilling mud particles that might otherwise clog side passageways and reduce the effectiveness of the nozzle 8 within the drilling bit 32 for its intended purposes. Thus, the side passageways 14 typically define straight, cylindrical bores through the sidewall 26 of the nozzle 8, although an oval or slit shape may be alternately used. The inlet orifices 24 leading to side passageways 14 in the preferred embodiment of present invention are staggered as depicted in FIG. 2. This staggering is unique in that it helps to maintain substantially constant velocity of drilling mud moving within the central passageway 10, thereby increasing the effectiveness of the nozzle in cleaning, lubrication, and increasing the overall efficiency of the drill bit 32. Inlet orifices 24 leading to side passageways 14 in a nozzle that are not staggered tend to decrease the fluid velocities found in the central passageway 10 of the nozzle 8 because side passageways 14 draw fluid (drilling mud) away from the central passageway 10. Consequently, without staggered side passageways 14, velocity of drilling mud within the nozzle 8 is diminished, thereby causing a much higher probability that side passageways 14 will become plugged. This would cause a decrease in drill bit efficiency as cuttings in the bore are not washed away. By staggering the placement of inlet orifices 24 leading to the side passageways 14, drilling mud moving through the nozzle 8, has opportunity to maintain fluid velocity prior to encountering a subsequent side passageway 14 and corresponding inlet orifice 24. The staggered side passageways 14, when used in conjunction with a central passageway 10 that employs a descending tapered shape, work to maintain fluid velocity uniformity within the central passageway 10. Consequently, the fluid velocities in the central passageway 10 will remain substantially uniform at each of the inlet orifices 24, while simultaneously precisely directing flow to those objects or voids within the drill bit 32 most in need of fluid washing. Typically in the preferred embodiment, the cross-sectional area (true flow area) of the main inlet aperture 12 will be greater than the total cross-sectional areas (true flow areas) of all exit orifices 22 of the side passageways 14 and the main exit aperture 16 of the nozzle 8. Preferably, the area of a cross-sectional horizontal plane within the central passageway 10 (or 28) at the point of each inlet orifice 24 is greater than the sum of the cross-sectional area of the main exit aperture 16 and the cross-sectional areas of all exit orifices 22 occurring below the cross-sectional horizontal plane. The inlet orifices 24 and corresponding side passageways 14 are staggered so that, within the nozzle 8, distances exist between the midpoints of all inlet orifices 24. Typically, side passageways 14 form angles in the range of ten to one-hundred seventy degrees with a central vertical axis of the nozzle, with such angles forming in either an upward or downward direction.

Figure 3:
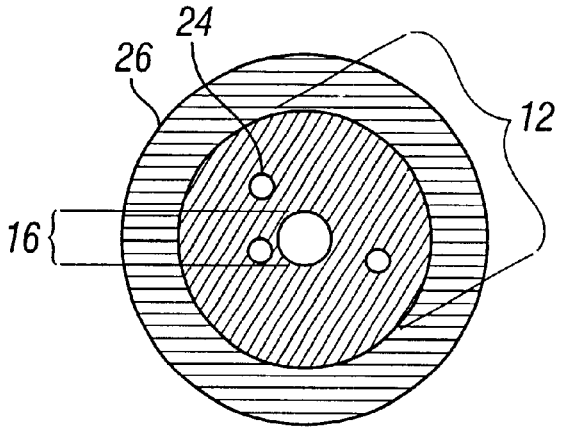
FIG. 3 is a top view of the non-plugging center jet nozzle depicted in FIG. 2

FIG. 3 is a top view of the center jet nozzle 8 depicted in FIG. 2 wherein the of inlet orifices 24 leading to side passageways 14 are shown. Although not to scale, FIG. 3 additionally demonstrates the relative difference in the cross-sectional areas (true flow areas) of the inlet aperture 12 of the nozzle 8 and the main exit aperture 16 found at the base of the nozzle 8. The placement of the inlet orifices 24 on the drawing is illustrative of the staggering that one would observe looking down into a nozzle 8. The drawing depicts three inlet orifices 24, however, this invention contemplates a plurality of such inlet orifices 24 (and their corresponding side passageways 14) leading from the central passageway 10 through and out the sidewall 26.

FIG. 4 is a side cross-sectional view of a second embodiment of the present invention wherein the non-plugging nozzle 8 comprises a sectional descending central passageway 28 with a plurality of staggered inlet orifices 24 leading to side passageways 14. This embodiment has the same general limitations of the first embodiment, however, is different with respect to the central passageway 28 that benefits from a contoured, rather than simple conical descending taper of the first embodiment central passageway 10. This sectional descending shaping further facilitates non-plugging action of the nozzle 8 as particles in drilling mud are swept toward the central passageway 28 vertical axis as passing drilling mud conforms with the shape of the passageway 28. The nozzle embodiment of FIG. 4 retains the benefit of consistency of fluid velocity as drilling mud moves from the inlet aperture 12 of the nozzle down toward the main exit aperture 16 which has a smaller cross-sectional area (true flow area) than the inlet aperture 12. A general descending tapering is still apparent in the sectional descending central pathway 28 and works in conjunction with staggered inlet orifices 24 leading to side passageways 14 to maintain consistent velocity within the nozzle central passageway 10. Another difference between the first and second embodiment relates to the placement of inlet orifices 24 leading to staggered side passageways 14 on the second embodiment. The inlet orifices 24 only occur at positions along the sectional descending central passageway 28 that are parallel with the nozzle central vertical axis. Thus, inlet orifices 24 are not found on the contoured portion of the sectional descending central passageway 28.

Figure 5:
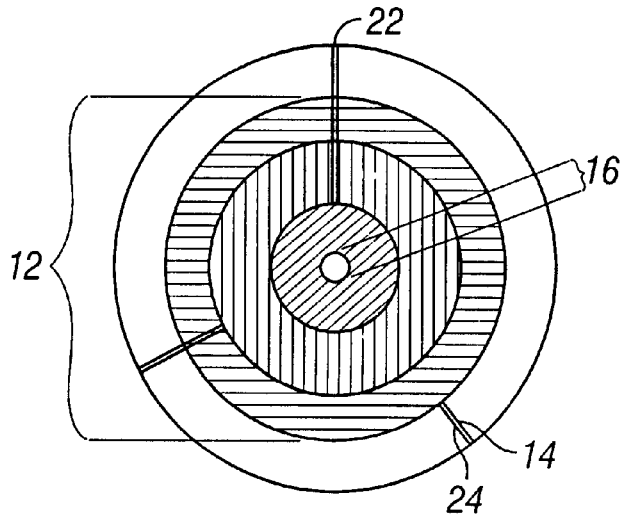
FIG. 5 is a top view of the non-plugging center jet nozzle depicted in FIG. 4.

FIG. 5 is a top view of the centerjet nozzle depicted in FIG. 4. Although not to scale, FIG. 5 demonstrates the relative difference in cross-sectional areas (true flow areas) between the main inlet aperture 12 and the main exit aperture 16. Separate concentric circles depict what one might observe in terms of sectional tapering occurring in the central passageway 28 of this embodiment. The drawing also shows the position of the nozzle sidewall 26 as viewed from the top. FIG. 5 depicts three sections forming the central passageway 28, however, this embodiment contemplates a plurality of descending sections. FIG. 5 additionally depicts the position of side passageways 14 extending through the nozzle sidewall 26.

It is to be noted, however, that the appended drawings illustrate only typical embodiments of this invention and are therefore not to be considered limiting of its scope, for the invention may admit to other equally effective embodiments.

I claim:

1. A three-cone rock bit comprising:

a drill hit body comprising a first end to connect with a drill string and a second end delimiting a cutting surface formed by a plurality of rotary cutter cones, said plurality of rotary cutter cones having at least one void defined above the cutter cones;

a nozzle located above said cutter cones along a central vertical axis of said bit body;

said nozzle further comprising a sidewall and a central passageway, said central passageway defining an inlet aperture at a top of the nozzle, and a main exit aperture at a bottom of the nozzle;

said central passageway of said nozzle defining a descending tapering shape;

said bit body further comprising an opening passageway extending through a top portion of said bit body in an axial direction, thereby keeping said drill string in fluid communication with said nozzle;

means for attaching said nozzle within the opening passageway of said bit body;

said nozzle further comprising a plurality of side passageways extending through the sidewall intermediate the top and bottom of the nozzle, each of said side passageways comprising an exit orifice at an exterior surface of said nozzle;

a plurality of inlet orifices;

each said inlet orifice leading to a corresponding said side passageway;

said plurality of inlet orifices being individually, vertically staggered along said central passageway;

each said inlet orifice sized to restrict passage of particles too large to completely pass through said corresponding side passageway; and said main exit aperture having a greater diameter then each said inlet orifice.

2. The three-cone rock bit of claim 1 wherein the central passageway of said nozzle is defined by a sectional descending shape.

3. The three-cone rock bit of claim 1 wherein the central passageway of said nozzle is defined by a conical descending shape.

4. The three-cone rock bit of claim 1 wherein the inlet aperture on said nozzle has a greater cross-sectional area than a total of cross-sectional areas of the main exit aperture and all said exit orifices on the nozzle.

5. The three-cone rock bit of claim 1 further comprising:

said central passageway comprising a horizontal cross sectional plane at each said inlet orifice of said plurality of said side passageways;

and with an area of an uppermost said horizontal cross-sectional plane being greater than a sum of a cross-sectional area of the main exit aperture and cross-sectional areas of all exit orifices occurring below said horizontal cross-sectional plane.

6. The three-cone rock bit of claim 1 wherein the means for functionally attaching said nozzle within said opening passageway of the bit body comprises a threadable screwing device.

7. The three-cone rock bit of claim 1 wherein the means for functionally attaching said nozzle within said opening passageway of the bit body comprises a lock down mechanism.

8. The three-cone rock bit of claim 1 wherein said nozzle comprises a mating fixture extending from an exterior of the nozzle sidewall for locking the nozzle into a static position when said nozzle is connected within the opening passageway.

9. The three-cone rock bit of claim 1 wherein said side passageways within the nozzle form an angle of between ten and one-hundred-seventy degrees with respect to a central vertical axis of said nozzle.

10. The three-cone rock bit of claim 1 wherein said side passageways further comprise an oval shape throughout the length of said side passageways, thus adapted to create a fanning spray of drilling mud.

11. The three-cone rock bit of claim 1 wherein said side passageways further comprise a slit shape throughout the length of said side passageways, thus adapted to create a fanning spray of drilling mud.

12. The three-cone rock bit of claim 1 wherein said main exit aperture on said nozzle has a diameter of at least 8/32 inches.

13. A non-plugging center jet nozzle, comprising:

a top, a bottom, a sidewall, and a vertical axis, the nozzle further comprising a central passageway extending from the top to the bottom of the nozzle along said vertical axis;

said central passageway comprising an inlet aperture at the top of said nozzle, a main exit aperture at the bottom of the nozzle, and said central passageway having a descending tapering shape;

said nozzle further comprising a plurality of side passageways extending through the sidewall intermediate the top and bottom of the nozzle, said side passageways being in fluid communication with and intersecting with the central passageway;

a plurality of inlet orifices;

each said inlet orifice leading to a corresponding said side passageway;

said plurality of inlet orifices being individually, vertically staggered along said central passageway;

each said inlet orifice sized to restrict passage of particles too large to completely pass through said corresponding side passageway; and said main exit aperture having a greater diameter then each said inlet orifice.

14. The non-plugging center jet nozzle of claim 13 wherein the central passageway of said nozzle is defined by a sectional descending shape.

15. The non-plugging center jet nozzle of claim 13 wherein the central passageway of said nozzle is defined by a conical descending shape.

16. The non-plugging center jet nozzle of claim 13 wherein the inlet aperture on said nozzle has a greater cross-sectional area than a total of cross-sectional areas of the main exit aperture and all said exit orifices on the nozzle.

17. The non-plugging center jet nozzle of claim 12 further comprising: said central passageway comprising a horizontal cross sectional plane at each said inlet orifice of said plurality of said side passageways; and with an area of an uppermost said horizontal cross-sectional plane being greater than a sum of the cross-sectional area of the main exit aperture and cross-sectional areas of all exit orifices occurring below said horizontal cross-sectional plane.

18. The non-plugging center jet nozzle of claim 13 wherein said nozzle is attachable to a drill bit body by a threadable screwing device.

19. The non-plugging center jet nozzle of claim 13 wherein said nozzle is attachable to a drill bit body by a lock down mechanism.

20. The non-plugging center jet nozzle of claim 13 wherein said nozzle further comprises a mating fixture extending from an exterior of the nozzle sidewall for locking the nozzle into a static position when attached to a drill bit body.

21. The non-plugging center jet nozzle of claim 13 wherein said side passageways further comprise an oval shape throughout the length of said side passageway, thus adapted to create a fanning spray of drilling mud.

22. The non-plugging center jet nozzle of claim 13 wherein said side passageways further comprise a slit shape throughout the length of said side passageway, thus adapted to create a fanning spray of drilling mud.

23. The non-plugging center jet nozzle of claim 13 wherein said side passageways within the nozzle form an angle of between ten and one-hundred-seventy degrees with respect to said central vertical axis of said nozzle.

24. The non-plugging center jet nozzle of claim 13 wherein said main exit aperture on said nozzle has a diameter of at least 8/32 inches.

* * * * *